US012011028B2

(12) United States Patent
Capelli et al.

(10) Patent No.: US 12,011,028 B2
(45) Date of Patent: Jun. 18, 2024

(54) AEROSOL-GENERATING ARTICLE COMPRISING AN AEROSOL-GENERATING FILM

(71) Applicant: Philip Morris Products S.A., Neuchatel (CH)

(72) Inventors: Sebastien Capelli, Neuchatel (CH); Onur Dayioglu, Neuchatel (CH); Jean-Yves Vollmer, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 391 days.

(21) Appl. No.: 17/602,042

(22) PCT Filed: Mar. 18, 2020

(86) PCT No.: PCT/EP2020/057504
§ 371 (c)(1),
(2) Date: Oct. 7, 2021

(87) PCT Pub. No.: WO2020/207732
PCT Pub. Date: Oct. 15, 2020

(65) Prior Publication Data

US 2022/0192249 A1 Jun. 23, 2022

(30) Foreign Application Priority Data

Apr. 8, 2019 (EP) ..... 19167980

(51) Int. Cl.
*A24B 15/10* (2006.01)
*A24B 15/167* (2020.01)
(Continued)

(52) U.S. Cl.
CPC ..... *A24B 15/167* (2016.11); *A24B 15/186* (2013.01); *A24D 1/20* (2020.01); *A24F 40/10* (2020.01); *A24F 40/46* (2020.01)

(58) Field of Classification Search
CPC ..... A24B 15/167; A24B 15/186; A24D 1/20; A24F 40/10; A24F 40/46
(Continued)

(56) References Cited

U.S. PATENT DOCUMENTS 5,060,671 A 10/1991 Counts et al.
10,499,690 B2 * 12/2019 Thorens ..... A61M 15/003
(Continued)

FOREIGN PATENT DOCUMENTS

AU 2012207021 A1 8/2012
CN 106255430 A 12/2016
(Continued)

OTHER PUBLICATIONS

Combined Russian Office Action and Search Report issued Jul. 3, 2023 in Russian Patent Application No. 2021126702/03 (with English Translation), citing references 15 and 16 therein, 12 pages.
(Continued)

*Primary Examiner* — Harshad C Patel
(74) *Attorney, Agent, or Firm* — Oblon, McClelland, Maier & Neustadt, L.L.P.

(57) ABSTRACT

An aerosol-generating article is provided, including: a tubular carrier element defining a longitudinally extending internal cavity; and a layer of an aerosol-generating film applied to a portion of an inner surface of the tubular carrier element, such that an outer surface of the aerosol-generating film is exposed to the internal cavity of the tubular carrier element, the aerosol-generating film including at least 25 percent by weight of a polyhydric alcohol, and a thickness of the layer of the aerosol-generating film being between 0.05 millimeter and 1.0 millimeter. An aerosol-generating substrate for an aerosol-generating article, a method of making an aerosol-generating article, and an aerosol-generating system are also provided.

15 Claims, 1 Drawing Sheet

(51) Int. Cl.

| | |
|---|---|
| ***A24B 15/18*** | (2006.01) |
| ***A24D 1/20*** | (2020.01) |
| ***A24F 40/10*** | (2020.01) |
| ***A24F 40/46*** | (2020.01) |

(58) Field of Classification Search
USPC ..... 131/329
See application file for complete search history.

(56) References Cited

U.S. PATENT DOCUMENTS

| | | | | |
|---|---|---|---|---|
| 10,588,347 | B2 * | 3/2020 | Malgat | A24F 40/465 |
| 10,638,794 | B2 * | 5/2020 | Mahler | F22B 1/284 |
| 11,083,213 | B2 * | 8/2021 | Malgat | A24D 1/20 |
| 11,525,469 | B2 * | 12/2022 | Fujiwara | B23K 33/00 |
| 11,622,582 | B2 * | 4/2023 | Lim | A24F 40/51 131/273 |
| 2006/0021624 | A1 * | 2/2006 | Gonterman | A24D 3/14 131/335 |
| 2006/0185687 | A1 * | 8/2006 | Hearn | A24D 3/16 131/194 |
| 2009/0065011 | A1 * | 3/2009 | Maeder | A24D 1/22 131/194 |
| 2014/0166032 | A1 | 6/2014 | Gindrat | |
| 2014/0305448 | A1 * | 10/2014 | Zuber | A24D 1/20 131/328 |
| 2014/0373856 | A1 * | 12/2014 | Zuber | A24F 40/00 131/328 |
| 2015/0027474 | A1 * | 1/2015 | Zuber | A24D 3/17 131/329 |
| 2018/0199616 | A1 | 7/2018 | Gindrat | |
| 2022/0175017 | A1 * | 6/2022 | Capelli | A24B 15/167 |

FOREIGN PATENT DOCUMENTS

| | | | |
|---|---|---|---|
| CN | 108348004 | A | 7/2018 |
| CN | 108601403 | A | 9/2018 |
| CN | 108882752 | A | 11/2018 |
| CN | 109496128 | A | 3/2019 |
| DE | 10 2017 007 456 | A1 | 2/2019 |
| EP | 0 822 670 | A2 | 2/1998 |
| EP | 3 104 718 | A1 | 12/2016 |
| EP | 3 443 850 | A1 | 2/2019 |
| RU | 2 675 474 | C1 | 12/2018 |
| WO | WO 95/27411 | A1 | 10/1995 |
| WO | WO 2009/022232 | A2 | 2/2009 |
| WO | WO 2011/101164 | A1 | 8/2011 |
| WO | WO 2012/164009 | A2 | 12/2012 |
| WO | WO 2013/098409 | A1 | 7/2013 |
| WO | WO 2015/123422 | A1 | 8/2015 |
| WO | WO 2015/177255 | A1 | 11/2015 |
| WO | WO 2016/011623 | A1 | 1/2016 |
| WO | WO 2016/023965 | A1 | 2/2016 |
| WO | WO 2016/069876 | A1 | 5/2016 |
| WO | WO 2017/144861 | A1 | 8/2017 |
| WO | WO 2018/019543 | A1 | 2/2018 |
| WO | WO 2018/162515 | A1 | 9/2018 |
| WO | WO 2019/030274 | A1 | 2/2019 |

OTHER PUBLICATIONS

Extended European Search Report issued Nov. 4, 2019 in European Patent Application No. 19167980.2 citing documents AA, AB, and AV therein, 11 pages.
International Search Report and Written Opinion issued on Jun. 25, 2020 in PCT/EP2020/057504 filed on Mar. 18, 2020.
Combined Chinese Notice of Allowance and Search Report issued Aug. 23, 2023 in Chinese Patent Application No. 202080020088.7 (with English Translation of Notice of Allowance only), citing references 15-19 therein, 5 pages.

* cited by examiner

AEROSOL-GENERATING ARTICLE COMPRISING AN AEROSOL-GENERATING FILM

The present invention relates to a heated aerosol-generating article comprising an aerosol-generating film, and to a method for the production of such an aerosol-generating article.

Aerosol-generating articles in which an aerosol-generating substrate, such as a nicotine-containing substrate or a tobacco-containing substrate, is heated rather than combusted, are known in the art. Typically, in such heated smoking articles an aerosol is generated by the transfer of heat from a heat source to a physically separate aerosol-generating substrate or material, which may be located in contact with, within, around, or downstream of the heat source. During use of the aerosol-generating article, volatile compounds are released from the aerosol-generating substrate by heat transfer from the heat source and are entrained in air drawn through the aerosol-generating article. As the released compounds cool, they condense to form an aerosol.

A number of prior art documents disclose aerosol-generating devices for consuming aerosol-generating articles. Such devices include, for example, electrically heated aerosol-generating devices in which an aerosol is generated by the transfer of heat from one or more electrical heater elements of the aerosol-generating device to the aerosol-generating substrate of a heated aerosol-generating article.

Substrates for heated aerosol-generating articles have, in the past, often been produced using randomly oriented shreds, strands, or strips of tobacco material. As an alternative, rods for heated aerosol-generating articles formed from gathered sheets of tobacco material have been disclosed, by way of example, in international patent application WO-A-2012/164009.

International patent application WO-A-2011/101164 discloses alternative rods for heated aerosol-generating articles formed from strands of homogenised tobacco material, which may be formed by casting, rolling, calendering or extruding a mixture comprising particulate tobacco and at least one aerosol former to form a sheet of homogenised tobacco material. In alternative embodiments, the rods of WO-A-2011/101164 may be formed from strands of homogenised tobacco material obtained by extruding a mixture comprising particulate tobacco and at least one aerosol former to form continuous lengths of homogenised tobacco material.

Alternative forms of substrates comprising nicotine have also been disclosed. By way of example, liquid nicotine compositions, often referred to as e-liquids, have been proposed. These liquid compositions may, for example, be heated by a coiled electrically resistive filament of an aerosol-generating device.

Substrates of this type may require particular care in the manufacture of the containers holding the liquid composition in order to prevent undesirable leakages. To address this issue and simplify the overall manufacturing process, it has also been proposed to provide a gel composition comprising nicotine that generates a nicotine-containing aerosol upon heating. By way of example, WO-A-2018/019543 discloses a thermoreversible gel composition, that is, a gel that will become fluid when heated to a melting temperature and will set into a gel again at a gelation temperature. The gel is provided within a housing of a cartridge, and the cartridge can be disposed of and replaced when the gel has been consumed.

It would be desirable to provide an aerosol-generating article having a novel aerosol-generating film with improved stability. Additionally, it would be desirable to provide such an aerosol-generating article with an aerosol-generating film that has a high aerosol-former content, such that it can successfully be used as an aerosol-generating substrate. It would be particularly desirable to provide such an aerosol-generating article that is easier to dispose of after use or that has reduced environmental impact. It would be further desirable to provide such an aerosol-generating article that facilitates insertion of a heater element into the article during use.

The present invention relates to an aerosol-generating article comprising: a tubular carrier element defining a longitudinally extending internal cavity; and an aerosol-generating film. The aerosol-generating film may be provided over a portion of an inner surface of the tubular carrier element. The outer surface of the aerosol-generating film may be exposed to the internal cavity of the tubular carrier element. The aerosol-generating film may comprise at least 25 percent by weight of a polyhydric alcohol. The thickness of the aerosol-generating film may be between about 0.05 millimetres and about 1.0 millimetre.

According to a first aspect of the present invention there is provided an aerosol-generating article comprising: a tubular carrier element defining a longitudinally extending internal cavity; and an aerosol-generating film provided over a portion of an inner surface of the tubular carrier element, such that an outer surface of the aerosol-generating film is exposed to the internal cavity of the tubular carrier element, wherein the film comprises at least 25 percent by weight polyhydric alcohol and wherein the thickness of the film is between about 0.05 millimetres and about 1.0 millimetre.

According to a second aspect of the present invention there is provided an aerosol-generating substrate for use in an aerosol-generating article, the aerosol-generating substrate comprising: a tubular carrier element defining a longitudinally extending internal cavity; and an aerosol-generating film provided over a portion of an inner surface of the tubular carrier element, such that an outer surface of the aerosol-generating film is exposed to the internal cavity of the tubular carrier element, wherein the film comprises at least 25 percent by weight glycerin and wherein the thickness of the film is between about 0.05 millimetres and about 1.0 millimetre.

According to a third aspect of the present invention there is provided a method of making an aerosol-generating article, the method comprising the steps of: providing an aqueous film forming composition comprising glycerin; providing a sheet material; applying the aqueous film forming composition onto the surface of the sheet material to form a film layer; drying the film layer to form an aerosol-generating film comprising at least 25 percent by weight glycerin, wherein the thickness of aerosol-generating film is between 0.05 millimetres and 1.0 millimetre; and rolling the sheet material to form a tubular carrier element defining a longitudinally extending internal cavity and having the aerosol-generating film applied to a portion of the inner surface of the tubular carrier element.

According to a fourth aspect of the present invention there is provided an aerosol-generating system comprising an aerosol-generating article and an electrically operated aerosol-generating device comprising a heater and an elongate heating chamber configured to receive the aerosol-generating article so that the aerosol-generating article is heated in the heating chamber. The aerosol-generating article comprises: a tubular carrier element defining a longitudinally extending internal cavity; and an aerosol-generating film provided over a portion of an inner surface of the tubular carrier element, such that an outer surface of the aerosol-generating film is exposed to the internal cavity of the tubular carrier element, wherein the film comprises at least 25 percent by weight glycerin and wherein the thickness of the film is between about 0.05 millimetres and about 1.0 millimetre.

According to a fifth aspect of the present invention there is provided an aerosol-generating system comprising an aerosol aerosol-generating article and an electrically operated aerosol-generating device comprising a heater element configured to heat an aerosol-generating substrate of the aerosol-generating article. The aerosol-generating article comprises an aerosol-generating substrate comprising: a tubular carrier element defining a longitudinally extending internal cavity; and an aerosol-generating film provided over a portion of an inner surface of the tubular carrier element, such that an outer surface of the aerosol-generating film is exposed to the internal cavity of the tubular carrier element, wherein the film comprises at least 25 percent by weight polyhydric alcohol and wherein the thickness of the film is between about 0.05 millimetres and about 1.0 millimetre. The heater element is a heater blade or a heater pin configured to be inserted into the cavity such that the heater blade or heater pin faces the outer surface of the aerosol-generating film.

Any references herein to features of the aerosol-generating article according to the present invention should be assumed to apply to all aspects of the present invention, unless stated otherwise.

As used herein, the term "aerosol-generating article" refers to an aerosol-generating article for producing an aerosol comprising an aerosol-generating substrate that is intended to be heated rather than combusted in order to release volatile compounds that can form an aerosol.

As used herein, the term "aerosol-generating substrate" refers to a substrate capable of releasing upon heating volatile compounds, which can form an aerosol. The aerosol generated from aerosol-generating substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

Substrates for heated aerosol-generating articles typically comprise an "aerosol former", that is, a compound or mixture of compounds that, in use, facilitates formation of the aerosol, and that preferably is substantially resistant to thermal degradation at the operating temperature of the aerosol-generating article. Examples of suitable aerosol-formers include: polyhydric alcohols, such as propylene glycol, triethylene glycol, 1,3-butanediol and glycerin; esters of polyhydric alcohols, such as glycerol mono-, di- or triacetate; and aliphatic esters of mono-, di- or polycarboxylic acids, such as dimethyl dodecanedioate and dimethyl tetradecanedioate.

The polyhydric alcohol in the aerosol-generating film of the aerosol-generating articles of the invention is also an aerosol former within the meaning set out above.

As used herein, the term "film" describes a solid laminar element having a thickness that is less than the width or length thereof.

The film may be self-supporting. In other words, a film may have cohesion and mechanical properties such that the film, even if obtained by casting a film-forming formulation on a support surface, can be separated from the support surface.

Alternatively, the film may be disposed on a support or sandwiched between other materials. This may enhance the mechanical stability of the film.

The "thickness" of the aerosol-generating film of aerosol-generating articles according to the invention corresponds to the minimum distance measured between opposite, substantially parallel surfaces of a film.

The thickness of the aerosol-generating film may substantially correspond to the thickness to which a corresponding film-forming composition is cast or extruded, as the cast or extruded film-forming composition substantially does not contract during drying, despite the loss of water.

The "weight" of the aerosol-generating film of aerosol-generating articles according to the invention will generally correspond to the weight of the components of the corresponding film-forming composition minus the weight of water evaporated during the drying step. If a film is self-supporting, the film can be weighed on its own. If a film is disposed on a support, the film and the support may be weighed and the weight of the support, measured prior to deposition of the film, is subtracted from the combined weight of the film and the support.

Unless stated otherwise, percentages by weight of components of the aerosol-generating film recited herein are based on the total weight of the aerosol-generating film.

As used herein, the term "longitudinal" refers to the direction corresponding to the main longitudinal axis of the aerosol-generating article, which extends between the upstream and downstream ends of the aerosol-generating article. During use, air is drawn through the aerosol-generating article in the longitudinal direction. The term "transverse" refers to the direction that is perpendicular to the longitudinal axis.

Any reference to the "cross-section" of the aerosol-generating article or a component of the aerosol-generating article refers to the transverse cross-section unless stated otherwise. As used herein, the term "length" refers to the dimension of a component in the longitudinal direction and the term "width" refers to the dimension of a component in the transverse direction.

As used herein, the terms "upstream" and "downstream" describe the relative positions of elements, or portions of elements, of the aerosol-generating article in relation to the direction in which the aerosol is transported through the aerosol-generating article during use.

As described above, the present invention provides an aerosol-generating article having a novel arrangement of an aerosol-generating substrate. According to the invention, the aerosol-generating substrate is in the form of an aerosol-generating film provided on the inner surface of a tubular carrier element. In particular, a layer of the aerosol-generating film is applied to at least a portion of the inner surface of the tubular carrier element. The outer surface of the aerosol-generating film is exposed inside the longitudinal internal channel defined by the tubular carrier element. Upon heating, an aerosol is generated from the aerosol-generating film which is released into the internal channel and can be drawn through the aerosol-generating article into the consumer's mouth. The aerosol-generating film can be provided instead of, or in addition to, any other aerosol-generating substrate within the aerosol-generating article.

The tubular carrier element provides a support surface for the thin film of aerosol-generating film. The aerosol-generating film is supported on the inner surface of the tubular carrier element and affixed thereto such that it remains in place during use. The use of a tubular carrier element therefore provides a convenient way to incorporate the aerosol-generating film into the aerosol-generating article. The tubular carrier element with the aerosol-generating film applied can be readily incorporated into existing constructions of aerosol-generating articles without the need for significant modification and the aerosol-generating articles according to the invention can therefore potentially be manufactured at high speed using existing manufacturing apparatus and methods. The aerosol-generating film can be readily heated either externally from outside of the tubular carrier element, or internally by means of a heat element inserted into the internal channel of the tubular carrier element, as described in more detail below. By providing the aerosol-generating film on the inner surface of a tubular carrier element, the internal channel of the tubular carrier element can remain unobstructed which may facilitate the insertion of a heater element into the aerosol-generating article.

The composition of the aerosol-generating film may be selected such that the majority of the components of the film evaporate upon heating, during use of the aerosol-generating article, leaving minimal residue inside the hollow tubular carrier element. This may advantageously provide an aerosol-generating article that is easier to dispose of and has a reduced environmental impact.

The properties and composition of the aerosol-generating film can be readily adapted in order to control the resultant aerosol generated upon heating of the film. The use of the aerosol-generating film also enables a highly consistent aerosol to be provided to the consumer.

The aerosol-generating film of the aerosol-generating articles according to the present invention has a thickness of between about 0.05 millimetres and about 1.0 millimetre. The use of a tubular carrier element enables a relatively thin layer of aerosol-generating film to be provided. The amount of the aerosol-generating film can therefore be minimised whilst maximising the exposed surface area of the film. This optimises the efficiency of the release of aerosol from the aerosol-generating film. The amount of wastage of the aerosol-generating film may also be reduced.

Aerosol-generating articles according to the present invention are particularly suitable for use in an aerosol-generating system comprising an electrically heated aerosol-generating device having an internal heater element for heating the aerosol-generating substrate, as described in more detail below. For example, aerosol-generating articles according to the invention find particular application in aerosol-generating systems comprising an electrically heated aerosol-generating device having an internal heater blade which is adapted to be inserted into the aerosol-generating article proximate the aerosol-generating substrate. Aerosol-generating articles of this type are described in the prior art, for example, in European patent application EP-A-0 822 670.

The aerosol-generating films as described herein are particularly suitable for being heated from internally within the aerosol-generating article. When heated by an internal heater element, the aerosol-generating film on the inner surface of the tubular carrier element may shrink, which may advantageously bring the aerosol-generating film closer to the surfaces of the heater element, thereby optimising the heating of the aerosol-generating film.

As used herein, the term "aerosol-generating device" refers to a device comprising a heater element that interacts with the aerosol-generating substrate of the aerosol-generating article to generate an aerosol.

The aerosol-generating article according to the invention may comprise a combustible carbon heat source for heating the aerosol-generating substrate during use. Aerosol-generating articles of this type are described in the prior art, for example, in International patent application WO-A-2009/022232.

As described above, a tubular carrier element is provided to act as a support surface for the aerosol-generating film. The tubular carrier element is preferably a hollow cylindrical tube which preferably provides a cylindrical internal channel that extends through the tubular carrier element in a longitudinal direction. Preferably, the internal channel has a substantially circular transverse cross-section.

Preferably, the tubular carrier element has a wall thickness of between about 0.05 millimetres and about 0.5 millimetres, more preferably between about 0.15 millimetres and about 0.3 millimetres. The wall thickness may be selected depending upon the material used such that the desired level of rigidity can be provided.

The external diameter of the tubular carrier element is preferably approximately equal to the external diameter of the aerosol-generating article. This facilitates the incorporation of the tubular carrier element into the aerosol-generating article. Preferably, the outer diameter of the tubular carrier element is at least about 5 millimetres, more preferably at least 6 millimetres. Preferably, the external diameter of the tubular carrier element is less than or equal to about 10 millimetres, more preferably less than or equal to about 8 millimetres. In a preferred embodiment, the external diameter of the tubular carrier element is about 7 millimetres.

The tubular carrier element may be formed of any suitable material. Preferably, the tubular carrier element is a hollow tube formed of a cellulosic sheet material, such as paper or cardboard. In some embodiments of the invention, the tubular carrier element is formed of a laminate sheet material comprising an outer layer of paper or cardboard and an inner layer of metal, such as aluminium. In such embodiments, the aerosol-generating film is provided over the metal layer. The inclusion of a metal layer may advantageously optimise the heating of the aerosol-generating film during use.

In some embodiments of the invention, the tubular carrier element may be provided for the purposes of supporting the aerosol-generating film only. The tubular carrier element therefore provides the aerosol-generating substrate component of the aerosol-generating article, which may be combined with one or more additional components to form the aerosol-generating article. In such embodiments, the tubular carrier element will only extend along the aerosol-generating article as far as the aerosol-generating film and the length of the tubular carrier element will be smaller than the length of the aerosol-generating article. For example, in such embodiments, the length of the tubular carrier element may be between about 7 millimetres and about 15 millimetres.

More preferably, the tubular carrier element extends along the full length of the aerosol-generating article with only an upstream portion of the tubular carrier element having the aerosol-generating film applied to the internal surface. In such embodiments, the upstream portion of the tubular carrier element constituting the aerosol-generating substrate is integral to the remainder of the aerosol-generating article. The portion of the tubular carrier element downstream of the aerosol-generating film can advantageously be adapted to provide the other desired components of the aerosol-generating article, as described in more detail below. The use of a single, integral tube to provide the aerosol-generating article may facilitate the assembly of the aerosol-generating article. In such embodiments, the length of the tubular carrier element is preferably between about 30 millimetres and about 50 millimetres.

As described above, in the aerosol-generating articles according to the present invention, the aerosol-generating film is applied to at least a portion of the inner surface of the tubular carrier element. Preferably, the aerosol-generating film is provided at the upstream end of the aerosol-generating article, which is the end that is typically heated when the aerosol-generating article is inserted into an aerosol-generating device.

Preferably, the aerosol-generating film is applied to at least the upstream portion of the inner surface of the tubular carrier element. In embodiments in which the tubular carrier element provides the aerosol-generating substrate, with other components provided separately downstream, as described above, the aerosol-generating film may be applied to substantially the entire inner surface of the tubular carrier element. In alternative embodiments in which the tubular carrier element extends the full length of the aerosol-generating article, as described above, the aerosol-generating film is preferably applied only to an upstream portion of the inner surface of the tubular carrier element. For example, in such embodiments, the aerosol-generating film may extend longitudinally from an upstream end of the tubular carrier element for less than about 50 percent of the length of the tubular carrier element, or for less than about 35 percent of the length of the tubular carrier element.

Preferably, the aerosol-generating film extends at least about 6 millimetres along the length of the tubular carrier element, more preferably at least about 8 millimetres longitudinally along the tubular carrier element. Preferably, the aerosol-generating film extends longitudinally no more than about 15 millimetres along the tubular carrier element, more preferably no more than about 12 millimetres along the tubular carrier element. Preferably, the aerosol-generating film extends from the upstream edge of the tubular carrier element although in some embodiments, the upstream end of the aerosol-generating film may be provided at a distance from the upstream edge of the tubular carrier element.

Preferably, the aerosol-generating film extends circumferentially all of the way around the inner surface of the tubular carrier element.

The arrangement of the aerosol-generating film on the inner surface of the tubular carrier element means that the outer surface of the aerosol-generating film is exposed to the internal cavity of the tubular carrier element. This enables the aerosol-generating film to be heated and allows for the volatile components generated upon heating of the aerosol-generating film to be released into the internal cavity. The exposed surface area of the aerosol-generating film may be adapted depending on the desired level of aerosol delivery during use. Preferably, the surface area of the outer surface of the aerosol-generating film exposed to the internal cavity is at least about 0.5 square centimetres, more preferably at least 1 square centimetre. Preferably, the surface area of the outer surface of the aerosol-generating film exposed to the internal cavity is less than about 2.5 square centimetres, more preferably less than about 2 square centimetres. For example, the surface area of the outer surface of the aerosol-generating film exposed to the internal cavity may be between about 0.5 square centimetres and about 2.5 square centimetres, or between about 1 square centimetre and about 2 square centimetres.

The thickness of the aerosol-generating film in the aerosol-generating articles according to the present invention is at least about 0.05 millimetres, preferably at least about 0.1 millimetres, more preferably at least about 0.15 millimetres. The thickness of the aerosol-generating film is no more than about 1.0 millimetres, preferably no more than about 0.5 millimetres, more preferably no more than about 0.3 millimetres. For example, the thickness of the film may be between about 0.05 millimetres and about 1.0 millimetre, or between about 0.1 millimetres and about 0.5 millimetres, or between about 0.15 millimetres and about 0.3 millimetres. The present invention therefore provides a relatively thin layer of the aerosol-generating film so that the ratio of the surface area to the weight of the film can be maximised. This improves the efficiency of release of the volatile components from the aerosol-generating film upon heating. The use of a relatively thin layer of the aerosol-generating film also enables the weight of the film to be kept low whilst retaining a sufficient surface area. This advantageously decreases the thermal inertia of the aerosol-generating film, to further improve the efficiency of aerosol generation.

The weight of the aerosol-generating film in the tubular element may also be adapted depending on the desired level of aerosol delivery during use. Preferably, the weight of the aerosol-generating film is selected such that substantially all of the volatile components of the aerosol-generating film are released during a typical heating cycle of the aerosol-generating article, in order to minimise waste and maximise degradability of the tubular carrier element.

Preferably, the tubular carrier element provides at least about 20 milligrams of the aerosol-generating film, more preferably at least about 50 milligrams, more preferably at least about 100 milligrams. Preferably, the tubular carrier element provides no more than about 300 milligrams of the aerosol-generating film, more preferably no more than about 200 milligrams. For example, the tubular carrier element may provide between about 20 milligrams and about 300 milligrams of the aerosol-generating film, or between about 50 milligrams and about 200 milligrams of the aerosol-generating film, or between about 100 milligrams and about 200 milligram of the aerosol-generating film.

The aerosol-generating film preferably has a basis weight of at least about 100 grams per square metre, more preferably at least about 120 grams per square metre, most preferably at least about 140 grams per square metre. Preferably, the aerosol-generating film has a basis weight of no more than 300 grams per square metre, more preferably no more than 280 grams per square metre, most preferably no more than 260 grams per square metre. For example, the aerosol-generating film may have a basis weight of between about 100 grams per square metre and about 300 grams per square metre, or between about 120 grams per square metre and about 280 grams per square metre, or between about 140 grams per square metre and about 260 grams per square metre.

In certain embodiments of the present invention, the aerosol-generating film may be textured over at least a part of its surface. As used herein the term "textured" refers to a film that has been crimped, embossed, debossed, perforated or otherwise locally deformed. For example, the aerosol-generating film may comprise a plurality of spaced-apart indentations, protrusions, perforations or a combination thereof. Texture may be provided on one side of the aerosol-generating film, or on both sides of the aerosol-generating film. The provision of texture may advantageously increase the exposed surface area of the aerosol-generating film to improve the efficiency of release of the volatile components of the aerosol-generating film upon heating.

In a particularly preferred embodiment, the aerosol-generating film is crimped. As used herein, the term "crimped" denotes a film having a plurality of substantially parallel ridges or corrugations.

The aerosol-generating film of aerosol-generating articles according to the present invention has a composition comprising at least about 25 percent by weight of a polyhydric alcohol, more preferably at least about 30 percent by weight of a polyhydric alcohol, more preferably at least about 35 percent by weight of a polyhydric alcohol, more preferably, at least about 40 percent by weight of a polyhydric alcohol.

Preferably, the aerosol-generating film preferably comprises less than about 90 percent by weight of a polyhydric alcohol, more preferably less than about 80 percent by weight of a polyhydric alcohol, more preferably less than about 70 percent by weight of the polyhydric alcohol, more preferably less than about 60 percent by weight of a polyhydric alcohol.

For example, the aerosol-generating film may comprise between about 25 percent by weight and about 90 percent by weight of the polyhydric alcohol, or between about 30 percent by weight and about 80 percent by weight of the polyhydric alcohol, or between about 35 percent by weight and about 70 percent by weight of the polyhydric alcohol, or between about 40 percent by weight and about 60 percent by weight of the polyhydric alcohol.

Polyhydric alcohols suitable for use in the aerosol-generating film include, but are not limited to, propylene glycol, triethylene glycol, 1,3-butanediol, and glycerin. Preferably, in an aerosol-generating film in accordance with the invention the polyhydric alcohol is selected from the group consisting of glycerin, propylene glycol, and combinations thereof. In particularly preferred embodiments the polyhydric alcohol is glycerin.

Thus, the invention advantageously provides a film having a significant polyhydric alcohol content that can easily be cast or extruded and solidified starting from a composition having a gel-like texture. As significant percentages of the polyhydric alcohol, particularly glycerin, can be provided in film form, whilst at the same time being able to finely control the geometry of the film, the invention advantageously provides a film that is particularly suitable for use an aerosol-generating substrate in an aerosol-generating article designed to be heated to release the aerosol.

Preferably, the aerosol-generating film further comprises at least about 3 percent by weight of a cellulose based film-forming agent, more preferably at least about 6 percent by weight of a cellulose based film-forming agent, more preferably at least about 10 percent by weight of a cellulose based film-forming agent, more preferably at least about 14 percent by weight of a cellulose based film-forming agent, more preferably at least about 16 percent by weight of a cellulose based film-forming agent, more preferably at least about 18 percent by weight of a cellulose based film-forming agent.

The aerosol-generating film may comprise up to about 70 percent by weight of a cellulose based film-forming agent. Preferably, the aerosol-generating film preferably comprises no more than about 26 percent by weight of the cellulose based film-forming agent, more preferably no more than about 24 percent by weight of the cellulose based film-forming agent, more preferably no more than about 22 percent by weight of the cellulose based film-forming agent.

For example, the aerosol-generating film may comprise between about 3 percent by weight and about 70 percent by weight of a cellulose based film-forming agent, or between about 6 percent by weight and about 26 percent by weight of a cellulose based film-forming agent, or between about 10 percent by weight and about 24 percent by weight of a cellulose based film-forming agent, or between about 14 percent by weight and about 24 percent by weight of a cellulose based film-forming agent, or between about 16 percent by weight and about 22 percent by weight of a cellulose based film-forming agent, or between about 18 percent by weight and about 22 percent by weight of a cellulose based film-forming agent.

In the context of the present invention the term "cellulose based film-forming agent" is used to describe a cellulosic polymer capable, by itself or in the presence of an auxiliary thickening agent, of forming a continuous film.

Preferably, the cellulose based film-forming agent is selected from the group consisting of hydroxypropyl methylcellulose (HPMC), methylcellulose (MC), ethylcellulose (EC), hydroxyethyl methyl cellulose (HEMC), hydroxyethyl cellulose (HEC), hydroxypropyl cellulose (HPC) and combinations thereof. In particularly preferred embodiment, the cellulose based film-forming agent is HPMC.

Preferably, in the aerosol-generating film a ratio between the weight of cellulose based film-forming agent and the weight of polyhydric alcohol is at least about 0.1, more preferably at least about 0.2, even more preferably about 0.3. In addition, or as an alternative, in the aerosol-generating film a ratio between the weight of cellulose based film-forming agent and the weight of polyhydric alcohol is preferably less than or equal to about 1.

In preferred embodiments, in the aerosol-generating film a ratio between the weight of cellulose based film-forming agent and the weight of polyhydric alcohol is from about 0.1 to about 1.

The inventors have surprisingly found that aerosol-generating films that comprise at least 6 percent by weight of a cellulose based film-forming agent, and preferably HPMC, are especially stable. Thus, they substantially maintain their shape when exposed to a variety of environmental conditions, such as a change in relative humidity from 10 percent to 60 percent. Accordingly, aerosol-generating films as described above advantageously do not release a liquid phase during storage or transportation.

Preferably, the aerosol-generating film further comprises at least about 1 percent by weight of a non-cellulose based thickening agent, more preferably at least about 2 percent by weight of the non-cellulose based thickening agent, more preferably at least about 3 percent by weight of the non-cellulose based thickening agent. Preferably, the aerosol-generating film preferably comprises no more than about 10 percent by weight of the non-cellulose based thickening agent, more preferably no more than about 8 percent by weight of the non-cellulose based thickening agent, more preferably no more than about 6 percent by weight of the non-cellulose based thickening agent. For example, the aerosol-generating film may comprise between about 1 percent by weight and about 10 percent by weight of the non-cellulose based thickening agent, or between about 2 percent by weight and about 8 percent by weight of the non-cellulose based thickening agent, or between about 3 percent by weight and about 6 percent by weight of the non-cellulose based thickening agent.

As used herein with reference to the invention, the term "non-cellulose based thickening agent" is used to describe a non-cellulosic substance that, when added to an aqueous or non-aqueous liquid composition, increases the viscosity of the liquid composition without substantially modifying its other properties. The thickening agent may increase stability, and improve suspension of components in the liquid composition. A thickening agent may also be referred to as a "thickener" or a "rheology modifier".

Preferably, in an aerosol-generating film in accordance with the invention the non-cellulose based thickening agent is selected from the group consisting of agar, xanthan gum, gum Arabic, guar gum, locust bean gum, pectin, carrageenan, starch, alginate, and combinations thereof. In preferred embodiments, the non-cellulose based thickening agent is agar.

Preferably, in the aerosol-generating film a ratio between the weight of non-cellulose based thickening agent and the weight of polyhydric alcohol is at least about 0.05, more preferably at least 0.1, even more preferably at least 0.2. In addition, or as an alternative, in the aerosol-generating film a ratio between the weight of non-cellulose based thickening agent and the weight of polyhydric alcohol is preferably less than or equal to about to 0.5.

In preferred embodiments, in the aerosol-generating film a ratio between the weight of non-cellulose based thickening agent and the weight of polyhydric alcohol is from about 0.1 to about 0.5.

The inventors have surprisingly found that incorporation of a combination of a cellulose based film-forming agent and a non-cellulose based thickening agent into the film together with the polyhydric alcohol may provide a film having improved stability that can be produced with high precision and repeatability.

Preferably, the aerosol-generating film comprises less than about 30 percent by weight water. More preferably, the aerosol-generating film comprises between about 10 percent by weight and about 20 percent by weight water.

In some embodiments, the aerosol-generating film further comprises an alkaloid compound or a cannabinoid compound or both.

As used herein with reference to the invention, the term "alkaloid compound" describes any one of a class of naturally occurring organic compounds that contain one or more basic nitrogen atoms. Generally, an alkaloid contains at least one nitrogen atom in an amine-type structure. This or another nitrogen atom in the molecule of the alkaloid compound can be active as a base in acid-base reactions. Most alkaloid compounds have one or more of their nitrogen atoms as part of a cyclic system, such as for example a heterocylic ring. In nature, alkaloid compounds are found primarily in plants, and are especially common in certain families of flowering plants. However, some alkaloid compounds are found in animal species and fungi. In the context of the present invention, the term "alkaloid compounds" is used to describe both naturally derived alkaloid compounds and synthetically manufactured alkaloid compounds.

Preferably, the alkaloid is selected from the group consisting of: nicotine, anatabine and combinations thereof.

As used herein with reference to the invention, the term "cannabinoid compound" describes any one of a class of naturally occurring compounds that are found in parts of the cannabis plant—namely the species *Cannabis sativa, Cannabis indica*, and *Cannabis ruderalis*. Cannabinoid compounds are especially concentrated in the female flower heads. Cannabinoid compounds naturally occurring the in cannabis plant include tetrahydrocannabinol (THC) and cannabidiol (CBD). In the context of the present invention, the term "cannabinoid compounds" is used to describe both naturally derived cannabinoid compounds and synthetically manufactured cannabinoid compounds.

Preferably, the aerosol-generating film comprises a cannabinoid compound selected from the group consisting of: tetrahydrocannabinol (THC), tetrahydrocannabinolic acid (THCA), cannabidiol (CBD), cannabidiolic acid (CBDA), cannabinol (CBN), cannabigerol (CBG), cannabigerol monomethyl ether (CBGM), cannabivarin (CBV), cannabidivarin (CBDV), tetrahydrocannabivarin (THCV), cannabichromene (CBC), cannabicyclol (CBL), cannabichromevarin (CBCV), cannabigerovarin (CBGV), cannabielsoin (CBE), cannabicitran (CBT) and combinations thereof.

In general, the aerosol-generating film may comprise up to about 10 percent by weight of an alkaloid compound or a cannabinoid compound or both. The content of alkaloid compound or cannabinoid compound or both in the film may be increased and adjusted with a view to optimising the delivery of alkaloid compound or cannabinoid compound or both in aerosol form to the consumer. Compared with existing aerosol-generating substrates based on the use of plant material, this may advantageously allow for higher contents of alkaloid compound or cannabinoid compound or both per volume of substrate (film) or per weight of substrate (film), which may be desirable from a manufacturing viewpoint.

Preferably, the aerosol-generating film comprises at least about 0.5 percent by weight of an alkaloid compound or a cannabinoid compound or both. Thus, the aerosol-generating film preferably comprises at least about 0.5 percent by weight of an alkaloid compound or at least 0.5 percent by weight of a cannabinoid compound or at least about 0.5 percent by weight of a combination of an alkaloid compound and a cannabinoid compound.

More preferably, the aerosol-generating film comprises at least about 1 percent by weight of an alkaloid compound or a cannabinoid compound or both, more preferably at least about 2 percent by weight of an alkaloid compound or a cannabinoid compound or both. The aerosol-generating film preferably comprises less than about 6 percent by weight of an alkaloid compound or a cannabinoid compound or both, more preferably less than about 5 percent by weight of an alkaloid compound or a cannabinoid compound or both, more preferably less than about 4 percent by weight of an alkaloid compound or a cannabinoid compound or both.

For example, the aerosol-generating film may comprise from about 0.5 percent by weight to about 10 percent by weight of an alkaloid compound or a cannabinoid compound or both, or from about 1 percent by weight to about 6 percent by weight of an alkaloid compound or a cannabinoid compound or both, or from about 2 percent by weight to about 5 percent by weight of an alkaloid compound or a cannabinoid compound or both.

In some embodiments, the aerosol-generating film comprises one or more of a cannabinoid and an alkaloid compound comprising nicotine or anatabine. In some preferred embodiments, the aerosol-generating film comprises nicotine.

As used herein with reference to the invention, the term "nicotine" is used to describe nicotine, a nicotine base or a nicotine salt. In embodiments in which the aerosol-generating film comprises a nicotine base or a nicotine salt, the amounts of nicotine recited herein are the amount of free base nicotine or amount of protonated nicotine, respectively.

The aerosol-generating film may comprise natural nicotine or synthetic nicotine.

The aerosol-generating film may comprise one or more monoprotic nicotine salts.

As used herein with reference to the invention, the term "monoprotic nicotine salt" is used to describe a nicotine salt of a monoprotic acid.

Preferably, the aerosol-generating film comprises at least about 0.5 percent by weight nicotine. More preferably, the aerosol-generating film comprises at least about 1 percent by weight nicotine. Even more preferably, the aerosol-generating film comprises at least about 2 percent by weight nicotine. In addition, or as an alternative, the aerosol-generating film preferably comprises less than about 10 percent by weight nicotine. More preferably, the aerosol-generating film comprises less than about 6 percent by weight nicotine. Even more preferably, the aerosol-generating film comprises less than about 5 percent by weight nicotine. For example, the aerosol-generating film may comprise between about 0.5 percent by weight and about 10 percent by weight nicotine, or between about 1 percent by weight and about 6 percent by weight nicotine, or between about 2 percent by weight and about 5 percent by weight nicotine.

In some preferred embodiments, the aerosol-generating film comprises a cannabinoid compound. Preferably, the cannabinoid compound is selected from CBD and THC. More preferably, the cannabinoid compound is CBD.

The aerosol-generating film may comprise up to about 10 percent by weight of CBD. Preferably, the aerosol-generating film comprises at least about 0.5 percent by weight CBD, more preferably at least about 1 percent by weight CBD, more preferably at least about 2 percent by weight CBD. Preferably, the aerosol-generating film preferably comprises less than about 6 percent by weight CBD, more preferably less than about 5 percent by weight CBD, more preferably less than about 4 percent by weight CBD.

For example, the aerosol-generating film may comprise from about 0.5 percent by weight to about 10 percent by weight CBD, more preferably from about 1 percent by weight to about 6 percent by weight CBD, even more preferably from about 2 percent by weight to about 5 percent by weight CBD.

The aerosol-generating film may be a substantially tobacco-free aerosol-generating film.

As used herein with reference to the invention, the term "substantially tobacco-free aerosol-generating film" describes an aerosol-generating film having a tobacco content of less than 1 percent by weight. For example, the aerosol-generating film may have a tobacco content of less than about 0.75 percent by weight, less than about 0.5 percent by weight or less than about 0.25 percent by weight.

The aerosol-generating film may be a tobacco-free aerosol-generating film.

As used herein with reference to the invention, the term "tobacco-free aerosol-generating film" describes an aerosol-generating film having a tobacco content of 0 percent by weight.

In some embodiments, the aerosol-generating film comprises tobacco material or a non-tobacco plant material or a plant extract. By way of example, the aerosol-generating film may comprise tobacco particles, such as tobacco lamina particles, as well as particles of other botanicals, such as clove and eucalyptus. Where the aerosol-generating film comprises tobacco, the tobacco content is preferably no more than about 70 percent by weight, more preferably no more than about 50 percent by weight, more preferably no more than about 30 percent by weight and most preferably no more than about 10 percent by weight.

In preferred embodiments, the aerosol-generating film comprises an acid. More preferably, the aerosol-generating film comprises one or more organic acids. Even more preferably, the aerosol-generating film comprises one or more carboxylic acids. In particularly preferred embodiments, the acid is lactic acid or levulinic acid.

The inclusion of an acid is especially preferred in embodiments of the aerosol-generating film comprising nicotine, as it has been observed that the presence of an acid may stabilise dissolved species in the film-forming composition, such as with nicotine and other plant extracts. Without wishing to be bound by theory, it is understood that the acid may interact with the nicotine molecule, especially where nicotine is provided in salt form, and this substantially prevents nicotine from evaporating during the drying operation. As such, the loss of nicotine during manufacturing of the film can be minimised, and higher, better controlled nicotine delivery to the consumer can advantageously be ensured.

Preferably, the aerosol-generating film comprises at least about 0.25 percent by weight of the acid. More preferably, the aerosol-generating film comprises at least about 0.5 percent by weight of the acid. Even more preferably, the aerosol-generating film comprises at least about 1 percent by weight of the acid. In addition, or as an alternative, the aerosol-generating film preferably comprises less than about 3.5 percent by weight of the acid. More preferably, the aerosol-generating film comprises less than about 3 percent by weight of the acid. Even more preferably, the aerosol-generating film comprises less than about 2.5 percent by weight of the acid.

For example, the aerosol-generating film may comprise between about 0.25 percent by weight and about 3.5 percent by weight of the acid, or between about 0.5 percent by weight and about 3 percent by weight of the acid, or between about 1 percent by weight and about 2.5 percent by weight of the acid.

The aerosol-generating film may optionally comprise a flavourant. In some embodiments, the aerosol-generating film may comprise up to about 2 percent by weight of a flavourant. By way of example, the aerosol-generating film may comprise one or more of: menthol, terpenes, terpenoids, eugenol and eucalyptol.

The aerosol-generating film may be produced by forming a film-forming composition of the components of the film, preferably an aqueous film-forming composition, casting or extruding the film-forming composition onto a support surface, leaving the film-forming composition to jellify and then drying the film-forming composition to obtain an aerosol-generating film. The film may then be detached from the support surface and incorporated into an aerosol-generating substrate for an aerosol-generating article. Alternatively, the film may be incorporated into an aerosol-generating substrate together with the support surface, for example in embodiments in which the aerosol-generating film is applied directly on a sheet material for forming the tubular carrier element, as described below.

Upon heating, most of the components of the aerosol-generating film are found to evaporate. In effect, it has been observed that only some residue of the cellulose based film-forming agent, where present, is typically left following use. As such, aerosol-generating articles incorporating substrates comprising an aerosol-generating film as described may be easier to dispose of, and may have an improved environmental impact.

During use, the aerosol-generating film may be heated to a temperature of between about 180 degrees Celsius to about 250 degrees Celsius in order to generate an aerosol. The inventors have surprisingly found that when the aerosol-generating film is heated in an aerosol-generating device, it may release polyhydric alcohol without substantially releasing a liquid phase.

Aerosol-generating articles according to the invention incorporate a tubular carrier element, as described above. As discussed, in certain preferred embodiments of the present invention, the tubular carrier element extends substantially the full length of the aerosol-generating article. In such embodiments, the tubular carrier element preferably incorporates one or more additional components of the aerosol-generating article. Preferably, the aerosol-generating article further comprises a flow restriction element within the internal cavity of the tubular carrier element, downstream of the aerosol-generating film. Preferably, the flow restriction element is held inside the internal cavity of the tubular carrier element by means of a friction fit.

The flow restriction element may advantageously be incorporated in order to provide the aerosol-generating article with an acceptable level of resistance to draw (RTD). Suitable flow restriction elements for providing a desired level of RTD would be known to the skilled person. In some embodiments, the flow restriction element may a constriction, such as one or more holes having a diameter that is smaller than the diameter of the internal cavity. In preferred embodiments, the flow restriction element comprises one or more plugs of fibrous filtration material, such as one or more cellulose acetate plugs.

The resistance to draw (RTD) of the aerosol-generating article after insertion of a heater element is preferably between about 40 mm WG and about 140 mm WG, more preferably between about 80 mm WG and about 120 mm WG.

As used herein, resistance to draw is expressed with the units of pressure 'mm WG' or 'mm of water gauge' and is measured in accordance with ISO 6565:2002.

The flow restriction element may extend to the downstream end of the tubular carrier element. Alternatively, the flow restriction element may extend to a position upstream of the downstream end of the tubular carrier element such that a hollow cavity is provided downstream of the flow restriction element.

The flow restriction element preferably extends longitudinally between about 15 millimetres and about 25 millimetres along the tubular carrier element.

Preferably, the flow restriction element is spaced apart from the aerosol-generating film in a longitudinal direction such that the flow restriction element and the aerosol-generating film are separated by a hollow space inside the internal cavity of the tubular carrier element. This separation of the components within the tubular carrier element advantageously provides space for the formation of the aerosol within the aerosol-generating article. Preferably, the longitudinal spacing between the flow restriction element and the aerosol-generating film is at least about 10 percent of the length of the tubular carrier element, more preferably at least about 20 percent of the length. Preferably, the length of the space between the aerosol-generating film and the flow restriction element is at least 50 percent of the length of the portion of the tubular carrier element covered by the aerosol-generating film.

Preferably at least one end of the tubular carrier element is sealed. Particularly preferably, both ends of the tubular carrier element are sealed. The sealing of the ends of the tube advantageously prevents the ingress of air and water into the internal cavity of the tubular carrier element prior to use. This helps to retain the freshness of the aerosol-generating film during storage in order to optimise the delivery of aerosol upon heating. Furthermore, the sealing of the ends of the tubular carrier element may reduce the loss of the volatile components of the aerosol-generating film during storage, so that the delivery of these components to the consumer can be maximised.

The sealing of the tubular carrier element at one or both ends may be carried out by any suitable means. Preferably, the or each open end of the tubular carrier element is covered by a sealing element which is affixed to the end of the tubular carrier element in order to cover the opening of the internal cavity. The sealing element is preferably in the form of a sheet of material that covers the opening of the internal cavity of the tubular carrier element. Preferably, the sheet of material is substantially impermeable. The sealing element may be formed of any suitable sheet material, including but not limited to paper, aluminium, polymer, or combinations thereof.

Preferably, a frangible sealing element is provided at the upstream end of the tubular element, wherein the frangible sealing element is adapted to obstruct airflow into and out of the internal cavity of the tubular carrier element. In such embodiments, the sealing element is frangible such that it can be pierced by a heater element or other piercing means upon insertion of the aerosol-generating article into an aerosol-generating device. A support element, such as a plug of fibrous filtration material may be provided directly behind the frangible sealing element, if desired, in order to facilitate the piercing of the frangible sealing element by the heater element or other piercing means.

Alternatively, the sealing element provided at the upstream end of the tubular carrier element may comprise a folded sheet or membrane which is adapted to receive a heater element and to unfold and extend as the heater element is inserted such that the sheet or membrane remains around the heater element during heating. This prevents contamination of the heater element. Preferably, in such embodiments, the folded sheet or membrane is formed of an aluminium sheet.

In a further alternative, the sealing element provided at the upstream end of the tubular carrier element may comprise a sheet or membrane having a recess extending longitudinally back into the internal cavity of the tubular carrier element and adapted to receive a heater element during use. As with the embodiment described above, the sheet or membrane remains around the heater element during use to prevent contamination of the heater element. Preferably, in such embodiments, the sheet or membrane comprising the recess is formed of an aluminium sheet.

Where a sealing element is provided at the upstream end of the tubular carrier element, the downstream end of the tubular carrier element may be left open. Alternatively, a sealing element may additionally be provided at the downstream end of the tubular carrier element, which may be the same or a different form to the sealing element provided at the upstream end.

Where a sealing element is provided at the downstream end, the downstream sealing element may be removable such that it can be removed from the aerosol-generating article prior to use.

Alternatively or in addition to the provision of a sealing element at the upstream end of the tubular carrier element, a tubular support element may be provided at the upstream end of the tubular carrier element. For example, a hollow acetate tube may be provided upstream of the aerosol-generating film at the upstream end of the tubular carrier element. The tubular support element may advantageously minimise the risk of loss of any of the aerosol-generating film from the aerosol-generating article prior to use. Furthermore, the tubular support element may facilitate the insertion and removal of an internal heater element into the aerosol-generating article during use of the aerosol-generating article in an aerosol-generating device. Furthermore, the tubular support element may be used to direct or control airflow through the aerosol-generating article.

As defined above, the second aspect of the present invention provides an aerosol-generating substrate for an aerosol-generating article, wherein the aerosol-generating substrate comprises a tubular carrier element having an aerosol-generating film applied to the inner surface. The tubular carrier element and the aerosol-generating film may have any of the features or properties described above in relation to the first aspect of the invention. However, according to the second aspect of the invention the tubular carrier element acts only as a support for the aerosol-generating film and is adapted to be combined with other components in an aerosol-generating article.

The aerosol-generating articles according to the invention, as described above, may be produced using a method according to the third aspect of the invention, as defined above. This method comprises a first step of providing an aqueous film-forming composition comprising polyhydric alcohol and a second step of providing a sheet material. In a third step, the aqueous film-forming composition is applied onto the surface of the sheet material to form a film layer and in a fourth step, the film layer is dried to form an aerosol-generating film having at least 25 percent by weight polyhydric alcohol and having a thickness of between about 0.05 millimetres and about 1.0 millimetre. In a fifth step, the sheet material is rolled to form a tubular carrier element defining a longitudinally extending internal cavity and having the aerosol-generating film applied to a portion of the inner surface of the tubular carrier element.

In such embodiments, the film layer may be deposited or infiltrated into the sheet material, which is preferably a cellulose based paper.

In an alternative method according to the invention, the aerosol-generating film is formed separately from the tubular carrier element and subsequently applied to the internal surface of the tubular carrier element.

In such embodiments, in a first step of the method according to the invention, a tubular carrier element is provided, wherein the tubular carrier element defines a longitudinally extending internal cavity. In a second step, an aqueous film-forming composition comprising polyhydric alcohol is provided. In a third step, the aqueous film-forming composition is applied onto a plane surface to form a film layer. In a fourth step, the film layer is dried to form an aerosol-generating film having at least 25 percent by weight polyhydric alcohol and having a thickness of between 0.05 millimetres and 1.0 millimetre. In a fifth step, the aerosol-generating film is applied to a portion of the inner surface of the tubular carrier element within the internal cavity such that an outer surface of the aerosol-generating film is exposed to the internal cavity.

The present invention further provides an aerosol-generating system comprising an aerosol-generating article according to the invention as described in detail above, in combination with an electrically operated aerosol-generating device which is adapted to receive the aerosol-generating article and which has a heater element configured to heat the aerosol-generating film provided inside the tubular carrier element of the aerosol-generating article such that an aerosol is generated.

Preferably, the heater element is configured to heat the aerosol-generating film to a temperature of between about 120 degrees Celsius and about 350 degrees Celsius, more preferably to a temperature of between about 200 degrees Celsius and about 220 degrees Celsius.

In the aerosol-generating systems according to the fourth aspect of the present invention, the electrically operated aerosol-generating device is configured to heat the aerosol-generating article externally, from outside of the tubular carrier element. An elongate heating chamber is provided, which is adapted to receive the aerosol-generating article and the heater element is provided circumferentially around the heating chamber to partially or fully surround the aerosol-generating article within the chamber so that the aerosol-generating film is heated.

In the aerosol-generating systems according to the fifth aspect of the present invention, the electrically operated aerosol-generating device is configured to heat the aerosol-generating article internally, from within the tubular carrier element. A heater element in the form of an elongate heater blade or pin is provided, which is adapted to be inserted into the internal cavity of the tubular carrier element such that the heater blade or pin faces the exposed outer surface of the aerosol-generating film in order to heat the aerosol-generating film.

In the aerosol-generating systems according to the invention, the heater element may be of any suitable form to conduct heat. The aerosol-generating system may be an electrically-operated aerosol generating system comprising an inductive heating device. Inductive heating devices typically comprise an induction source that is configured to be coupled to a susceptor. The induction source generates an alternating electromagnetic field that induces magnetization or eddy currents in the susceptor. The susceptor may be heated as a result of hysteresis losses or induced eddy currents heat the susceptor through ohmic or resistive heating.

Electrically operated aerosol-generating systems comprising an inductive heating device may also comprise the aerosol-generating article having the aerosol-generating film and a susceptor in thermal proximity to the aerosol-generating film. The susceptor is heated through hysteresis losses or induced eddy currents, which in turn heats the aerosol-generating film. Typically, the susceptor is in direct contact with the aerosol-generating film and heat is transferred from the susceptor to the aerosol-generating film primarily by conduction. Examples of electrically operated aerosol-generating systems having inductive heating devices and aerosol-generating articles having susceptors are described in WO-A1-95/27411 and WO-A1-2015/177255.

The invention will now be further described with reference to the figures in which.

Figure 1:
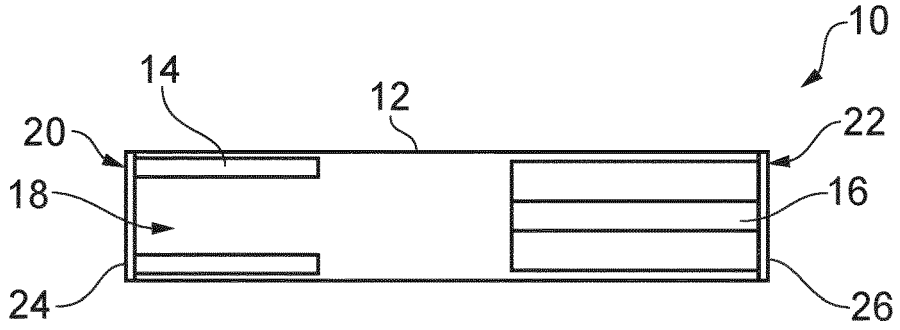
FIG. 1 shows a schematic longitudinal cross-sectional view of an aerosol-generating article according to a first embodiment of the invention.
Figure 3:
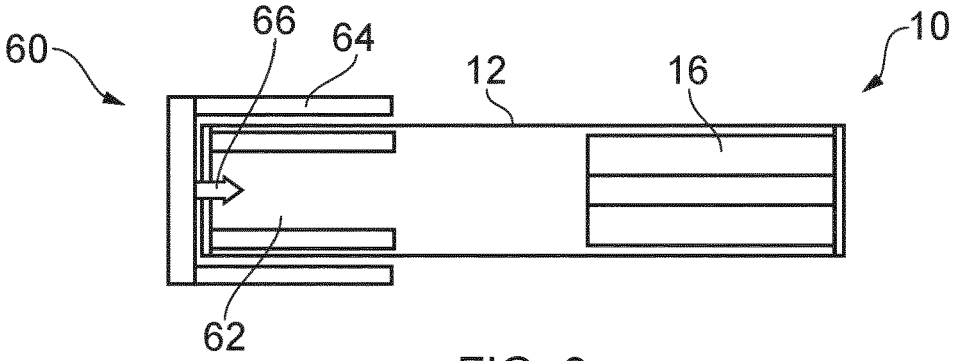
Figure 4:
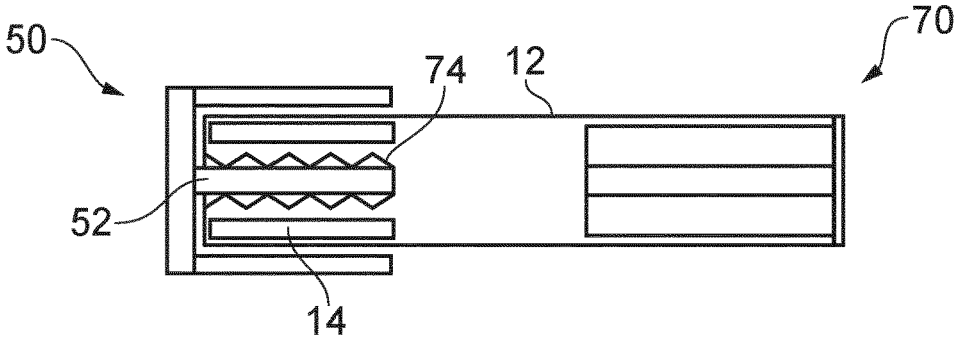

FIG. 3 shows a schematic longitudinal cross-sectional view of the aerosol-generating article of FIG. 1 in combination with an external heater element of an aerosol-generating device; and FIG. 4 shows a schematic longitudinal cross-sectional view of an aerosol-generating article according to a second embodiment of the invention in combination with an internal heater element of an aerosol-generating device.

The aerosol-generating article 10 shown in FIG. 1 comprises a tubular carrier element 12, an aerosol-generating film 14 and a flow restriction element 16.

The tubular carrier element 12 is in the form of a paper tube having a length of approximately 12 millimetres and an external diameter of approximately 7 millimetres. The tubular carrier element 12 is cylindrical in shape and defines a longitudinally extending internal cavity 18 extending from an upstream end 20 of the tubular carrier element 12 to a downstream end 22.

The aerosol-generating film 14 is provided as a single layer over the inner surface of the tubular carrier element 12. The aerosol-generating film 14 has a thickness of approximately 0.25 millimetres and extends from the upstream end 20 of the tubular carrier element 12 downstream along the internal cavity 18 to a distance of approximately 10 millimetres from the upstream end 20. The aerosol-generating film 14 therefore covers an area of approximately 2 square centimetres on the inner surface of the tubular carrier element 12.

The aerosol-generating film 14 has the following composition:

| Aerosol-generating film composition (w/w) |
|---|
| 19.3% HPMC |
| 4.8% Agar |
| 1.4% Nicotine |
| 48% Glycerin |
| 2.1% Levulinic Acid |
| 24.4% Water |

The flow restriction element 16 comprises a single segment of cellulose acetate tow which is provided within the internal cavity 18 of the tubular carrier element 12, at the downstream end 22. The flow restriction element 16 has a length of approximately 20 millimetres and an external diameter corresponding to the diameter of the internal cavity 18 of the tubular carrier element 12. The flow restriction element 16 is downstream of the aerosol-generating film 14 and spaced apart from the aerosol-generating film 14 such that an empty space is defined inside the tubular carrier element 12, between the downstream end of the aerosol-generating film 14 and the upstream end of the flow restriction element 16.

The upstream end 20 of the tubular carrier element 12 is sealed by means of upstream sealing element 24 which comprises a sheet of aluminium provided over the end of the tubular carrier element 12 to seal the upstream end of the internal cavity 18.

The downstream end 22 of the tubular carrier element 12 is sealed by means of downstream sealing element 26 which comprises a sheet of paper provided over the downstream end of the flow restriction element 16 at the downstream end of the tubular carrier element 12.

The aerosol-generating article 10 shown in FIG. 1 is suitable for use with an electrically operated aerosol-generating device comprising a heater for heating the aerosol-generating film 14.

Figure 2:
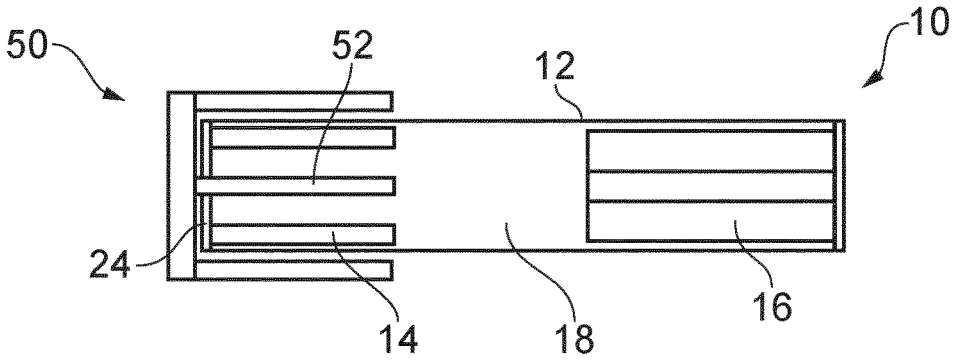
FIG. 2 shows a schematic longitudinal cross-sectional view of the aerosol-generating article of FIG. 1 in combination with an internal heater element of an aerosol-generating device.

FIG. 2 shows a schematic view of the aerosol-generating article 10 being heated in an aerosol-generating device 50 having a heater blade 52. The aerosol-generating article 10 is inserted into the aerosol-generating device 50 such that the heater blade 52 pierces through the upstream sealing element 24 and is inserted into the internal cavity 18 of the tubular carrier element 12. The heater blade 52 faces the outer surface of the aerosol-generating film 14 within the tubular carrier element 12. As can be seen from FIG. 2, the aerosol-generating film 14 is provided such that it extends approximately as far along the tubular carrier element 12 as the heater blade 52.

During use, the heater blade 52 heats the aerosol-generating film 14 to a temperature sufficient to generated an aerosol from the aerosol-generating film 14. The aerosol is drawn through the flow restriction element 16 and out through the downstream end 22 of the tubular carrier element.

FIG. 3 shows a schematic view of the aerosol-generating article 10 being heated in an alternative aerosol-generating device 60 having a heating chamber 62 into which the upstream end of the aerosol-generating article is inserted such that an external heater element 64 surrounds the upstream part of the tubular carrier element 12 incorporating the aerosol-generating film 14. The heater element 64 heats the aerosol-generating film 14 circumferentially from outside the tubular carrier element 12. As can be seen from FIG. 3, the aerosol-generating film 14 extends approximately as far along the tubular carrier element 12 as the heater element 64.

The aerosol-generating device 60 further comprises a piercing element 66 which pierces the upstream sealing element 24 as the aerosol-generating article 10 is inserted into the heating chamber 62.

FIG. 4 shows an aerosol-generating article 70 according to a second embodiment of the present invention, which is similar in construction to the aerosol-generating article 10 shown in FIG. 1 but comprises a modified upstream sealing element 74. The aerosol-generating article 70 is adapted for use with an aerosol-generating device 50 having a heater blade 52, as described above with reference to FIG. 2.

The upstream sealing element 74 of the aerosol-generating article 70 comprises a aluminium membrane which has been pre-folded in a concertina arrangement. Prior to use, the aluminium membrane is pre-folded and gathered so that the membrane lies substantially flat with the folds inside the internal cavity of the tubular carrier element 12. As the aerosol-generating article 70 is inserted into the aerosol-generating device 50, the heater blade 52 pushes against the folded aluminium membrane, which unfolds and extends as the heater blade 52 is pushed inwards into the tubular carrier element 12. The aluminium membrane surrounds the heater blade 52 so that the heater blade 52 remains covered during use.

The invention claimed is:

1. An aerosol-generating article, comprising:

a tubular carrier element defining a longitudinally extending internal cavity; and a layer of an aerosol-generating film applied to a portion of an inner surface of the tubular carrier element, such that an outer surface of the aerosol-generating film is exposed to the internal cavity of the tubular carrier element, wherein the aerosol-generating film comprises at least 25 percent by weight of a polyhydric alcohol, and wherein a thickness of the layer of the aerosol-generating film is between 0.05 millimeter and 1.0 millimeter.

2. The aerosol-generating article according to claim 1, wherein the aerosol-generating film further comprises at least 10 percent by weight of a cellulose based film-forming agent.

3. The aerosol-generating article according to claim 1, wherein the aerosol-generating film extends longitudinally from an upstream end of the tubular carrier element for less than about 50 percent of a length of the tubular carrier element.

4. The aerosol-generating article according to claim 1, wherein a surface area of the outer surface of the aerosol-generating film exposed to the internal cavity is at least about 1 square centimeter.

5. The aerosol-generating article according to claim 1, wherein the aerosol-generating film is crimped.

6. The aerosol-generating article according to claim 1, further comprising a flow restriction element within the internal cavity of the tubular carrier element and downstream of the aerosol-generating film.

7. The aerosol-generating article according to claim 6, wherein the flow restriction element is configured to provide the aerosol-generating article with an RTD of at least about 80 mm WG.

8. The aerosol-generating article according to claim 6, wherein a longitudinal spacing between the flow restriction element and a downstream end of the aerosol-generating film is at least about 10 percent of a length of the tubular carrier element.

9. The aerosol-generating article according to claim 1, wherein the tubular carrier element further comprises a coating layer comprising aluminum, the coating layer extending over at least a portion of the inner surface of the tubular carrier element, and wherein the layer of the aerosol-generating film is provided over the coating layer.

10. The aerosol-generating article according to claim 1, wherein at least one end of the tubular carrier element is sealed by a sealing element.

11. The aerosol-generating article according to claim 10, further comprising a frangible sealing element at an upstream end of the tubular carrier element, the frangible sealing element being configured to obstruct airflow into and out of the cavity.

12. An aerosol-generating substrate for an aerosol-generating article, the aerosol-generating substrate comprising:

a tubular carrier element defining a longitudinally extending internal cavity; and a layer of an aerosol-generating film applied to a portion of an inner surface of the tubular carrier element, such that an outer surface of the aerosol-generating film is exposed to the internal cavity of the tubular carrier element, wherein the aerosol-generating film comprises at least 25 percent by weight glycerin, and wherein a thickness of the layer of the aerosol-generating film is between 0.05 millimeter and 1.0 millimeter.

13. A method of making an aerosol-generating article, the method comprising the steps of:

providing an aqueous film-forming composition comprising glycerin;

providing a sheet material;

applying the aqueous film-forming composition onto a surface of the sheet material to form a film layer;

drying the film layer to form a layer of an aerosol-generating film comprising at least 25 percent by weight glycerin, wherein a thickness of the layer of the aerosol-generating film is between 0.05 millimeter and 1.0 millimeter; and rolling the sheet material to form a tubular carrier element defining a longitudinally extending internal cavity and having the layer of the aerosol-generating film applied to a portion of the inner surface of the tubular carrier element.

14. An aerosol-generating system, comprising:

an aerosol-generating article, comprising:

a tubular carrier element defining a longitudinally extending internal cavity, and a layer of an aerosol-generating film applied to a portion of an inner surface of the tubular carrier element, such that an outer surface of the aerosol-generating film is exposed to the internal cavity of the tubular carrier element, the aerosol-generating film comprising at least 25 percent by weight glycerin and a thickness of the layer of the aerosol-generating film being between 0.05 millimeter and 1.0 millimeter; and an electrically operated aerosol-generating device comprising a heater and an elongate heating chamber configured to receive the aerosol-generating article so that the aerosol-generating article is heated in the heating chamber.

15. An aerosol-generating system, comprising:

an aerosol aerosol-generating article, comprising:

an aerosol-generating substrate comprising a tubular carrier element defining a longitudinally extending internal cavity, and a layer of an aerosol-generating film applied to a portion of an inner surface of the tubular carrier element, such that an outer surface of the aerosol-generating film is exposed to the internal cavity of the tubular carrier element, the aerosol-generating film comprising at least 25 percent by weight polyhydric alcohol and a thickness of the layer of the aerosol-generating film being between 0.05 millimeter and 1.0 millimeter; and an electrically operated aerosol-generating device comprising a heater element configured to heat the aerosol-generating substrate of the aerosol-generating article, the heater element being a heater blade or a heater pin configured to be inserted into the cavity such that the heater blade or the heater pin faces the outer surface of the aerosol-generating film.

* * * * *